US008150082B2

(12) United States Patent
Saito et al.

(10) Patent No.: US 8,150,082 B2
(45) Date of Patent: Apr. 3, 2012

(54) WATERPROOF HEARING AID

(75) Inventors: Atsushi Saito, Tokyo (JP); Takashi Iwakura, Tokyo (JP); Keisuke Shinohara, Tokyo (JP)

(73) Assignee: Rion Co., Ltd., Tokyo (JP)

( * ) Notice: Subject to any disclaimer, the term of this patent is extended or adjusted under 35 U.S.C. 154(b) by 1259 days.

(21) Appl. No.: 11/884,914

(22) PCT Filed: Jan. 24, 2006

(86) PCT No.: PCT/JP2006/300986

§ 371 (c)(1),
(2), (4) Date: Aug. 22, 2007

(87) PCT Pub. No.: WO2006/090545

PCT Pub. Date: Aug. 31, 2006

(65) Prior Publication Data

US 2008/0165996 A1 Jul. 10, 2008

(30) Foreign Application Priority Data

Feb. 22, 2005 (JP) ..... 2005-045339

(51) Int. Cl.
*H04R 25/00* (2006.01)

(52) U.S. Cl. ..... 381/322; 381/324; 381/189

(58) Field of Classification Search ..... 381/322
See application file for complete search history.

(56) References Cited

U.S. PATENT DOCUMENTS

| | | | | |
|---|---|---|---|---|
| 4,852,177 | A * | 7/1989 | Ambrose | 381/338 |
| 4,867,267 | A * | 9/1989 | Carlson | 181/130 |
| 4,987,597 | A | 1/1991 | Haertl | |
| 5,220,612 | A * | 6/1993 | Tibbetts et al. | 381/328 |
| 5,530,763 | A * | 6/1996 | Aebi et al. | 381/322 |
| 5,535,282 | A * | 7/1996 | Luca | 381/328 |
| 5,995,636 | A * | 11/1999 | Tøpholm | 381/323 |
| 6,041,128 | A | 3/2000 | Narisawa et al. | |
| 6,738,487 | B1 | 5/2004 | Nageno et al. | |

FOREIGN PATENT DOCUMENTS

| | | |
|---|---|---|
| EP | 0310866 | 4/1989 |
| JP | 62-290296 | 12/1987 |
| JP | 07-222294 | 8/1995 |
| JP | 08-195999 | 7/1996 |
| JP | 10126897 | 5/1998 |
| JP | 2869505 B | 1/1999 |
| JP | 2000-078676 | 3/2000 |
| JP | 2000-341784 | 12/2000 |
| JP | 2001-189997 | 7/2001 |

* cited by examiner

*Primary Examiner* — Jeffrey Donels
*Assistant Examiner* — Christopher Uhlir
(74) *Attorney, Agent, or Firm* — Carrier Blackman & Associates, P.C.; Joseph P. Carrier; William D. Blackman

(57) ABSTRACT

There is provided a waterproof hearing aid capable of being worn without caring about the entry of sweat or water even at the time of sweating or bathing. The waterproof hearing aid has a first waterproof film stretchingly provided at the sound inlet of a microphone and a second waterproof film stretchingly provided at the sound outlet of an earphone, a tube (first vent) communicating a microphone chamber formed by the first waterproof film and the microphone with a hearing aid case chamber formed by a hearing aid case, a tube (second vent) communicating an earphone chamber formed by the second waterproof film and the earphone with the hearing aid case chamber, and a porous film (third vent) communicating the hearing aid case chamber with the outside.

16 Claims, 5 Drawing Sheets

(a)

(b)

WATERPROOF HEARING AID

CROSS-REFERENCE TO RELATED APPLICATIONS

The present application is a U.S. National phase of, and claims priority based on PCT/JP2006/300986, filed 24 Jan. 2006, which, in turn, claims priority from Japanese patent application 2005-045339, filed 22 Feb. 2005. The entire disclosure of each of the referenced priority documents is incorporated herein by reference.

TECHNICAL FIELD

The present invention relates to a waterproof hearing aid in which a waterproof structure is provided at the sound inlet of a microphone, at the sound outlet of an earphone, and at other locations.

BACKGROUND ART

To a hearing aid wearer, it is desirable that a hearing aid can be worn under any circumstances. For example, in the case where the wearer sweats as a result of a proper amount of exercise, in the case where the wearer bathes at an unfamiliar place such as a sports center, or in other cases, it is desirable that the wearer should not take off his/her hearing aid because of a need for sufficiently obtaining information through his/her acoustic sense. In such circumstances, however, the hearing aid wearer presently takes off his/her hearing aid or wears it while fretting about whether the hearing aid fails due to the entry of sweat or water.

In such a situation, as a waterproof structure for an ear-hang type hearing aid, a structure has been known in which a waterproof film holding member that holds a nonporous waterproof film is arranged in front of the sound inlet of a microphone, by which the enclosed state of a microphone chamber formed by the waterproof film holding member and a microphone case is improved (for example, refer to Patent Document 1).

Also, as a waterproof structure for an ear-insertion type hearing aid, a structure has been known in which a holed cap can be attached to a sound outlet connecting part of a hearing aid, and a microporous film made of non-tacky polytetrafluoroethylene is provided in the cap so that sounds can be transmitted easily and also earwax, moisture, sweat, and the like can be prevented from entering into the hearing aid from the auditory canal (for example, refer to Patent Document 2).

Further, a hearing aid has been known in which, a protective device using a nonporous diaphragm, which is formed of a material having a high sound propagation property such as titanium of 0.01 mm or thinner, in place of the microporous film is provided at a sound inlet opening and a sound outlet opening (for example, refer to Patent Document 3).

Patent Document 1: Japanese Patent No. 2869505

Patent Document 2: European Patent No. 0310866

Patent Document 3: Japanese Patent Application Publication No. 10-126897

However, in the waterproof structure of the hearing aid described in Patent Documents 1 and 3, the sound opening is covered with the nonporous waterproof film or the nonporous diaphragm, so that a sound entry pathway into the microphone (microphone chamber) and a sound exit pathway from an earphone (earphone chamber) become in an hermetically-sealed state, respectively. In such an enclosed state, if the air pressure or temperature on the outside of the hearing aid changes, a difference in air pressure arises between the inside and the outside of the enclosed space, and a pressure caused by this difference in air pressure acts on the waterproof film etc., by which a high tension is produced on the waterproof film. As the result, the acoustic impedance of the waterproof film etc. increases suddenly, and the attenuation of sound pressure caused by the waterproof film etc. increases, which poses a problem in that the sensitivity as a hearing aid decreases greatly.

Also, if the microporous film is used as described in Patent Document 2, the difference in air pressure does not arise, but the hearing aid of this type has a disadvantage that the hole in the film is easily clogged with earwax etc. Also, the microporous material formed of polytetrafluoroethylene has a larger specific gravity than a nonporous polyurethane elastomer material, and for this microporous material, if the film is made thin, the waterproof performance thereof decreases, so that it is difficult to sufficiently decrease the surface density of the film, which poses a problem in that it is difficult to sufficiently decrease the acoustic impedance of the film.

The acoustic impedance of film is substantially determined by the acoustic stiffness thereof in a frequency zone lower than the first resonance frequency of the film. The acoustic stiffness of a circular film is proportional to the tension of the film and inversely proportional to the biquadrate of the film diameter. Especially in the case of the ear-insertion type hearing aid, the diameter of waterproof film is about 2 mm from the viewpoint of design. If the film diameter decreases, the variation in film acoustic impedance with respect to the change in film tension increases suddenly. Thus, for the waterproof hearing aid, it is important to adjust the air pressure on the inside and the outside of the film so as to be in equilibrium to prevent the film tension from changing.

SUMMARY OF THE INVENTION

The present invention has been made to solve the above-described problems with the related art, and accordingly an object thereof is to provide a waterproof hearing aid capable of being worn without caring about the entry of sweat or water even at the time of sweating or bathing.

To solve the above problems, the invention according to aspect 1provides a waterproof hearing aid having a first waterproof film stretchingly provided at the sound inlet of a microphone and a second waterproof film stretchingly provided at the sound outlet of an earphone, includes a first ventilation means communicating a microphone chamber formed by the first waterproof film and the microphone with a hearing aid case chamber formed by a hearing aid case, a second ventilation means communicating an earphone chamber formed by the second waterproof film and the earphone with the hearing aid case chamber, and a third ventilation means communicating the hearing aid case chamber with the outside.

The invention according to aspect 2 is characterized in that in the waterproof hearing aid described in aspect 1, the first ventilation means is configured by a tube projecting into the hearing aid case chamber, a ventilation hole provided in the side wall of a tube forming a part of the microphone chamber, a permeable porous tube forming a part of the microphone chamber, or a ventilation hole provided in a microphone case.

The invention according to aspect 3 is characterized in that in the waterproof hearing aid described in aspect 1 or 2, the second ventilation means is configured by a tube projecting into the hearing aid case chamber, a ventilation hole provided in the side wall of a tube forming a part of the earphone chamber, or a permeable porous tube forming a part of the earphone chamber.

The invention according to aspect 4 is characterized in that in the waterproof hearing aid described in aspect 1, 2 or 3, the third ventilation means uses a porous film that allows a gas such as air to pass through, and is difficult to let a liquid such as water pass through easily.

The invention according to aspect 5 is characterized in that in the waterproof hearing aid described in aspect 1, 2, 3 or 4, the first waterproof film and the second waterproof film can be replaced freely.

As described above, according to the invention described in aspect 1, the first ventilation means communicating the microphone chamber with the hearing aid case chamber, the second ventilation means communicating the earphone chamber with the hearing aid case chamber, and the third ventilation means communicating the hearing aid case chamber with the outside are provided. Therefore, since the microphone chamber and the earphone chamber are in air communication with the outside, even if the outside air pressure or temperature changes, a difference in pressure between the hearing aid case chamber and the outside does not arise, and therefore a high tension is not produced on the waterproof film, so that a problem can be prevented in that the acoustic impedance of waterproof film increases suddenly, and the attenuation of sound pressure due to the waterproof film increases, thereby decreasing the sensitivity as a hearing aid greatly.

According to the invention described in aspect 2, the microphone chamber and the hearing aid case chamber can be made in air communication with each other easily. Therefore, the equilibrium of air pressures between the microphone chamber and the hearing aid case chamber is achieved smoothly.

According to the invention described in aspect 3, the earphone chamber and the hearing aid case chamber can be made in air communication with each other easily. Therefore, the equilibrium of air pressures between the earphone chamber and the hearing aid case chamber is achieved smoothly.

According to the invention described in aspect 4, the outside and the hearing aid case chamber can be made in air communication with each other easily without the entry of a liquid such as water into the hearing aid case chamber. Therefore, the equilibrium of air pressures between the outside and the hearing aid case chamber is achieved smoothly.

According to the invention described in aspect 5, the first waterproof film and the second waterproof film can be cleaned or replaced easily.

DETAILED DESCRIPTION OF BEST MODE FOR CARRYING OUT THE INVENTION

Figure 1:
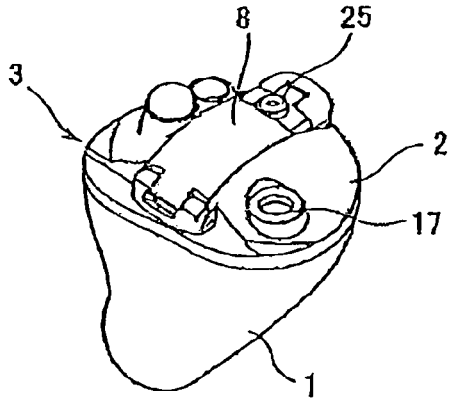
FIG. 1 is a perspective view of a waterproof hearing aid in accordance with the present invention.
Figure 2:
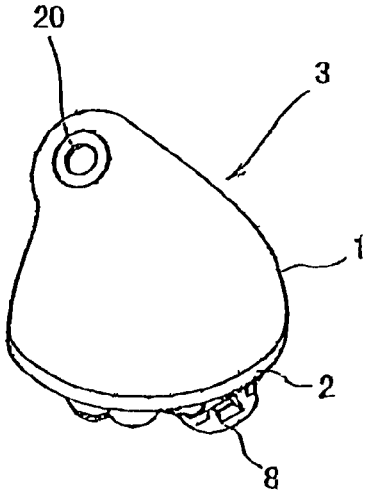
FIG. 2 is a perspective view of a waterproof hearing aid in accordance with the present invention.
Figure 6:
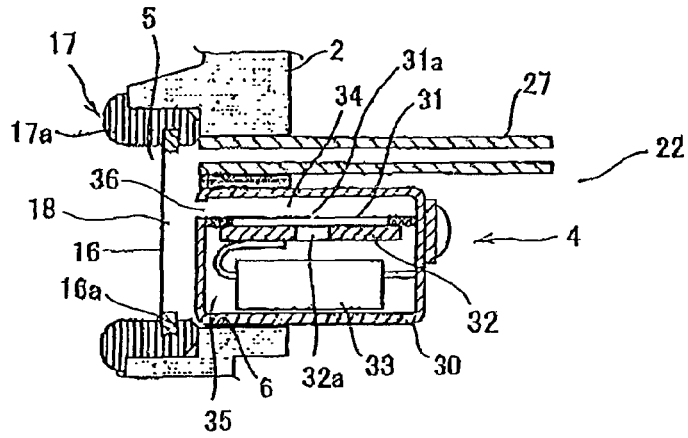
FIG. 6 is a detailed sectional view of a waterproof structure and a first ventilation means of a microphone.
Figure 7:
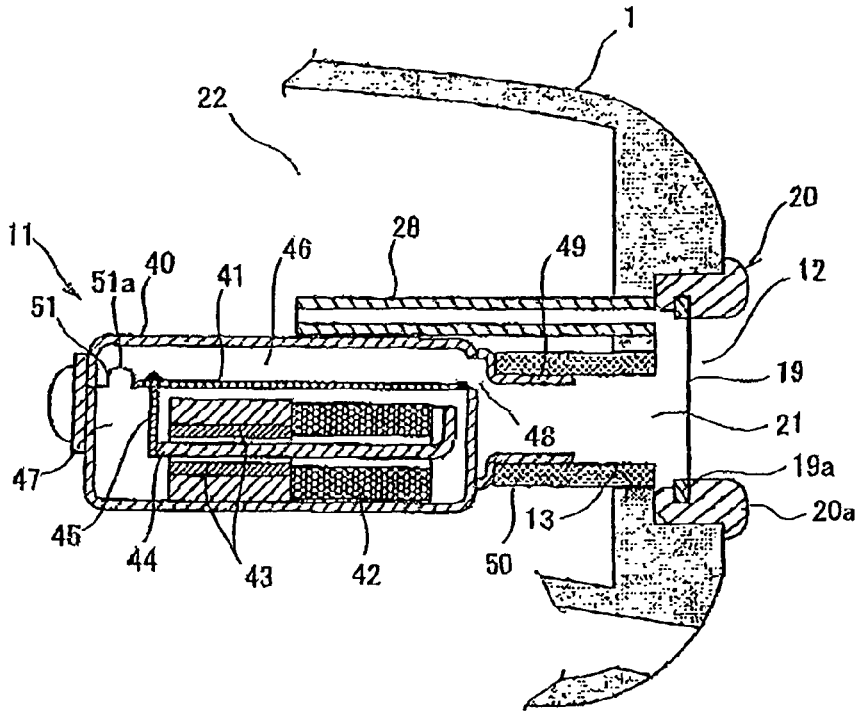
FIG. 7 is a detailed sectional view of a waterproof structure and a second ventilation means of an earphone.
Figure 8:
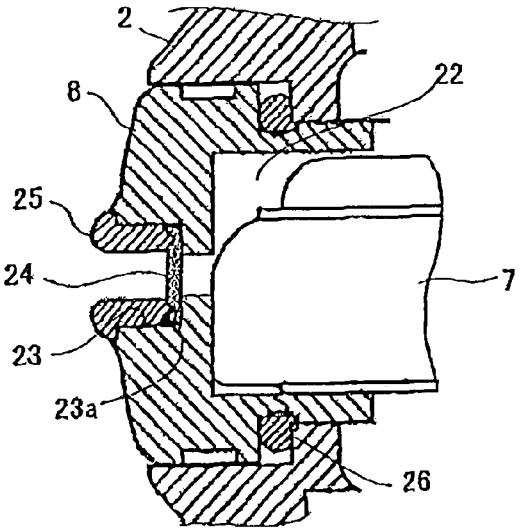
FIG. 8 is a detailed sectional view of a third ventilation means.

Embodiments of the present invention will now be described with reference to the accompanying drawings. FIGS. 1 and 2 are perspective views of a waterproof hearing aid in accordance with the present invention, FIG. 3 is a perspective view showing a state in which a battery cover of the waterproof hearing aid is open, FIG. 4 is a sectional view showing a state in which the waterproof hearing aid is worn, FIG. 5 is a sectional view of the waterproof hearing aid, FIG. 6 is a detailed sectional view of a waterproof structure and a first ventilation means of a microphone, FIG. 7 is a detailed sectional view of a waterproof structure and a second ventilation means of an earphone, and FIG. 8 is a detailed sectional view of a third ventilation means.

Figure 3:
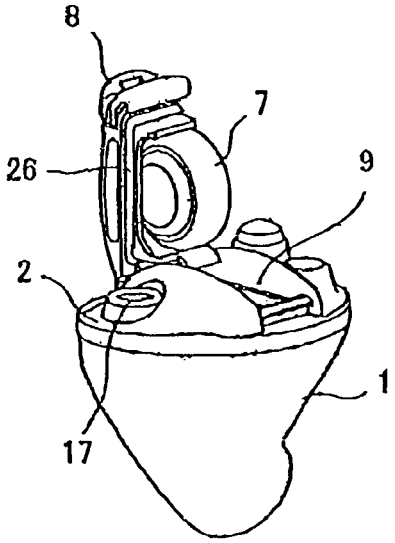
FIG. 3 is a perspective view showing a state in which a battery cover of a waterproof hearing aid in accordance with the present invention is open.

As shown in FIGS. 1 to 3, the waterproof hearing aid in accordance with the present invention is an ear-insertion type hearing aid having a hearing aid case 3 formed by a shell 1 and a face plate 2 that covers the opening of the shell 1. The external shape of the shell 1 is formed so as to fit the wall part of an external auditory canal 10 when the hearing aid is worn as shown in FIG. 4.

Figure 5:
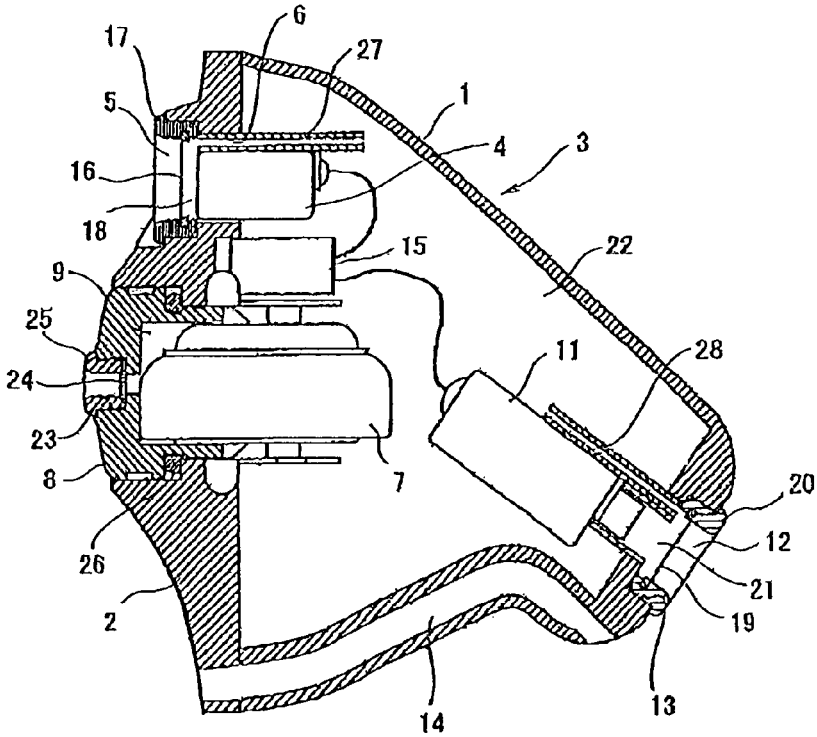
FIG. 5 is a sectional view of a waterproof hearing aid in accordance with the present invention.

As shown in FIG. 5, the face plate 2 is formed with a sound inlet 5 of a microphone 4, a mounting hole 6 for the microphone 4, which communicates with the sound inlet 5, a battery cover housing part 9 that houses a battery cover 8 holding a battery 7, and the like. Also, at the tip end of the shell 1, a sound outlet 12 of an earphone 11 and a mounting hole 13 for the earphone 11, which communicates with the sound outlet 12, are formed.

Figure 4:
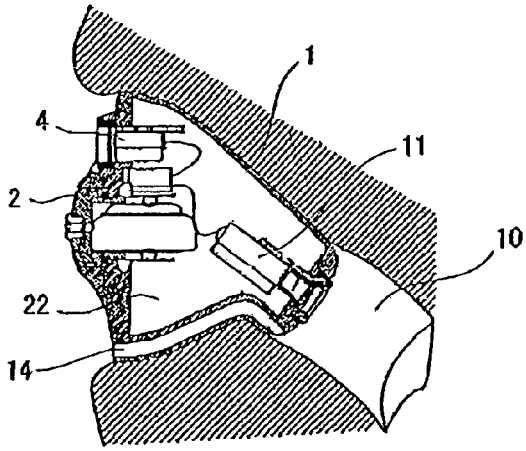
FIG. 4 is a sectional view showing a state in which a waterproof hearing aid in accordance with the present invention is worn.

In the case of a custom-made hearing aid in which the shell 1 is manufactured by making a model of ear of the hearing aid wearer, as shown in FIG. 4, a vent hole 14 for ventilation between the outside and the external auditory canal 10 at the time of wearing is provided in the shell 1. However, in the case of a general-purpose ear-insertion type hearing aid for which a model of ear of the hearing aid wearer is not made, it is expected that ventilation will be maintained between the outside and the external auditory canal through a gap between the shell and the external auditory canal wall, which is formed at the time of wearing, so that no vent hole is provided.

As shown in FIG. 5, a waterproof chip 17 stretchingly provided with a waterproof film 16 engages with the sound inlet 5 of the microphone 4, and a microphone chamber 18 is formed by the waterproof chip 17 and the microphone 4 that is fitted in the mounting hole 6 and fixed with an adhesive. Also, with the sound outlet 12 of the earphone 11 as well, a waterproof chip 20 stretchingly provided with a waterproof film 19 engages, and an earphone chamber 21 is formed by the waterproof chip 20 and the earphone 11 that is fitted in the mounting hole 13 and fixed with an adhesive. Reference numeral 15 denotes a signal processing part.

The battery cover 8 is formed with a through hole 23 that causes the outside and the interior of the hearing aid case 3 (a hearing aid case chamber 22) to communicate with each other, and a cap 25 stretchingly provided with a porous film (third ventilation means) 24 engages with the through hole 23. Further, the battery cover 8 is mounted with an O-ring 26, so that when the battery cover 8 is made in a closed state, a waterproof structure such that water etc. do not enter into the hearing aid case chamber 22 is formed.

By using an elastic high-molecular film, for example, formed of polyurethane elastomer having a thickness of about 0.01 mm as the waterproof film 16, the acoustic impedance of the waterproof film 16 can be decreased to a value negligible with respect to the input acoustic impedance of the microphone 4. Thereby, almost the same sense of hearing as in the case where the waterproof film 16 is not mounted can be obtained because the sound pressure applied to the microphone 4 scarcely attenuates even if passing through the waterproof film 16.

As shown in FIG. 6, after being bonded to an annularly shaped frame 16*a*, the waterproof film 16 is inserted in a mold when a cylindrical body 17*a* of the waterproof chip 17 is molded, and is fixed to the cylindrical body 17*a* by molding. Thereby, the waterproof chip 17 consisting of the waterproof film 16, the frame 16*a*, and the cylindrical body 17*a* is formed. The cylindrical body 17*a* molded by using an elastic high-molecular material is inserted under pressure into the sound inlet 5 having an inside diameter slightly smaller than the outside diameter of the cylindrical body 17*a*, so that the cylindrical body 17*a* functions as a packing to contribute to the improvement in waterproofness of the microphone chamber 18.

Also, as the waterproof film 19 as well, an elastic high-molecular film, for example, formed of polyurethane elastomer having a thickness of about 0.01 mm same as that of the waterproof film 16 is used, by which the acoustic impedance of the waterproof film 19 can be decreased to a value negligible with respect to the output acoustic impedance of the earphone 11. Thereby, almost the same sense of hearing as in the case where the waterproof film 19 is not mounted can be obtained because the sound pressure delivered from the earphone 11 to the external auditory canal scarcely attenuates even if passing through the waterproof film 19.

As shown in FIG. 7, after being bonded to an annularly shaped frame 19*a*, the waterproof film 19 is inserted in a mold when a cylindrical body 20*a* of the waterproof chip 20 is molded, and is fixed to the cylindrical body 20*a* by molding. Thereby, the waterproof chip 20 consisting of the waterproof film 19, the frame 19*a*, and the cylindrical body 20*a* is formed. The cylindrical body 20*a* molded by using an elastic high-molecular material is inserted under pressure into the sound outlet 12 having an inside diameter slightly smaller than the outside diameter of the cylindrical body 20*a*, so that the cylindrical body 20*a* functions as a packing to contribute to the improvement in waterproofness of the earphone chamber 21.

The waterproof chip 17 and the waterproof chip 20 engage with the face plate 2 or the shell 1 merely by utilizing elasticity, so that these chips 17 and 20 can be removed easily by using tweezers, and therefore can be replaced with new ones. That is to say, the waterproof film 16 can be replaced freely because the waterproof chip 17 can be replaced freely, and the waterproof film 19 can be replaced freely because the waterproof chip 20 can be replaced freely.

Also, as shown in FIG. 6, at the side of the microphone 4, a tube (first ventilation means) 27 that communicates the microphone chamber 18 with the hearing aid case chamber 22 is provided so that the air pressures in the microphone chamber 18 and the hearing aid case chamber 22 are in equilibrium. If the air pressures in the microphone chamber 18 and the hearing aid case chamber 22 are not in equilibrium, the microphone chamber 18 becomes an enclosed space, and therefore a difference in air pressure is produced between the microphone chamber 18 and the outside by a change in temperature or air pressure. Thus, tension is produced on the waterproof film 16 by this difference in air pressure, so that the acoustic impedance of the waterproof film 16 increases significantly, which resultantly decreases the sensitivity of hearing aid.

As shown in FIG. 7, at the side of the earphone 11 as well, a tube (second ventilation means) 28 that communicates the earphone chamber 21 with the hearing aid case chamber 22 is provided so that the air pressures in the earphone chamber 21 and the hearing aid case chamber 22 are in equilibrium. If the air pressures in the earphone chamber 21 and the hearing aid case chamber 22 are not in equilibrium, the earphone chamber 21 becomes an enclosed space, and therefore a difference in air pressure is produced between the earphone chamber 21 and the outside by a change in temperature or air pressure. Thus, tension is produced on the waterproof film 19 by this difference in air pressure, so that the acoustic impedance of the waterproof film 19 increases significantly, which resultantly decreases the sensitivity of hearing aid.

As shown in FIG. 6, the microphone 4 is of an electret condenser type, in which a box-shaped microphone case 30 contains a vibrating film 31, a back electrode electret 32, an impedance converter 33, and the like. Also, the microphone case 30 is partitioned into a vibrating film front chamber 34 and a vibrating film rear chamber 35 by the vibrating film 31. At a location where the microphone case 30 faces to the waterproof film 16, a sound intake port 36 communicating with the vibrating film front chamber 34 is formed. The sound pressure produced in the vibrating film front chamber 34 after having passed through the waterproof film 16 and the sound intake port 36 displaces the vibrating film 31 facing to the back electrode electret 32 with a proper gap being provided therebetween so that the acoustic signal is converted into an electrical signal.

In the microphone 4, the back electrode electret 32 is formed with one or a plurality of holes (back electrode holes) 32*a* to obtain satisfactory characteristics, and generally, the vibrating film 31 is also formed with a small hole (film ventilation hole) 31*a*. Therefore, the vibrating film front chamber 34 and the vibrating film rear chamber 35 communicate with each other, and the air pressures in the vibrating film front chamber 34 and the vibrating film rear chamber 35 are in equilibrium.

Also, as shown in FIG. 7, the earphone 11 is an electromagnetic earphone of a balanced armature type, in which a box-shaped earphone case 40 contains a vibrating plate 41, a coil 42, a magnet 43, an armature 44, a vibrating pin 45, and the like. Also, the earphone case 40 is partitioned into a vibrating plate front chamber 46 and a vibrating plate rear chamber 47 by the vibrating plate 41. At a location where the earphone case 40 faces to the waterproof film 19, a sound outlet 48 communicating with the vibrating plate front chamber 46 is formed. The earphone 11 is fixed with an adhesive by fitting the tip end of a rubber tube 50, which is put an a sound outlet 49 formed on the earphone case 40, in the mounting hole 13.

The sound pressure produced in the vibrating plate front chamber 46 by the vibration of the vibrating plate 41 passes through the sound outlet 48, the earphone chamber 21, and the waterproof film 19, and is propagated to the outside (external auditory canal). The edge part of the vibrating plate 41 is surrounded by a flexible high-molecular film 51, and the vibrating plate 41 is attached to the inner wall of the earphone case 40 via the high-molecular film 51. The high-molecular film 51 is formed with a small ventilation hole 51*a*. Therefore, the vibrating plate front chamber 46 and the vibrating plate rear chamber 47 communicate with each other, and the air pressures in the vibrating plate front chamber 46 and the vibrating plate rear chamber 47 are in equilibrium.

As shown in FIG. 8, the porous film (third ventilation means) 24 consists of a porous polytetrafluoroethylene film having a thickness of 0.3 mm, and is fixed by the press-fitted cap 25 made of a water-repellent plastic material after being dropped to a step part 23*a* in the through hole 23 formed in the battery cover 8. The porous film 24 has a property that the film lets water vapor pass through but does not let sweat and water pass through. Also, the porous film 24 has permeability such that the air pressures can become in equilibrium in about several seconds when a difference in air pressure arises between the interior of the hearing aid case chamber 22 and the outside.

If the time required for the equilibrium of air pressures becomes about 10 seconds or longer, the difference in air pressure between the interior of the hearing aid case chamber 22 and the outside, which is caused by an abrupt change in air pressure produced in an elevator or the like, does not disappear rapidly. Therefore, the sensitivity of hearing aid decreases, and therefore the hearing aid wearer feels difficulty in hearing.

Therefore, it is desirable that the air pressure in the hearing aid case chamber 22 become in equilibrium with the air pressure on the outside in a period of time as short as possible without sacrificing the waterproofness.

Also, it is desirable that the third ventilation means for ventilation between the hearing aid case chamber 22 and the outside be provided at a plurality of different locations. This is because if the third ventilation means is provided at one location only, although sufficient permeability is secured usually, the equilibrium of air pressures may be lost due to clogging of the porous film 24 with waterdrops or the like. If a plurality of the third ventilation means are provided, the possibility of all of the porous films 24 being clogged with waterdrops is lower than the case where third ventilation means is provided at one location.

Figure 9:
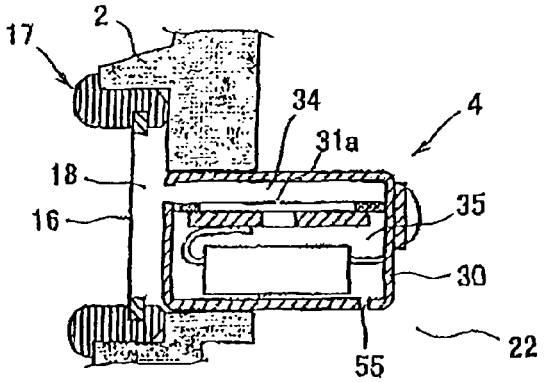
FIG. 9 is sectional views showing other embodiments of a first ventilation means, FIG. 9(*a*) showing a case where a ventilation hole is provided in a microphone case, and FIG. 9(*b*) showing a case where a ventilation hole is provided in a rubber tube.
Figure 9:
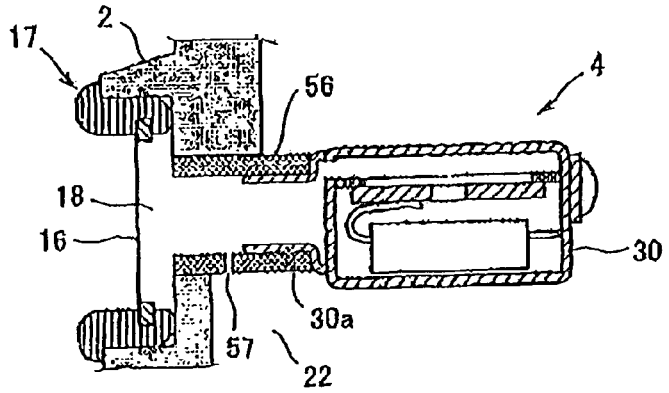

Next, as another embodiment of the first ventilation means, as shown in FIG. 9(*a*), a ventilation hole 55 is provided in the microphone case 30 in place of the tube 27 communicating the microphone chamber 18 with the hearing aid case chamber 22. Thereby, the equilibrium of air pressures between the microphone chamber 18 and the hearing aid case chamber 22 can be achieved through the film ventilation hole 31*a* formed in the vibrating film 31.

Also, as shown in FIG. 9(*b*), the configuration can be such that a cylindrical sound inlet 30*a* is formed on the microphone case 30, a rubber tube 56 is put on the sound inlet 30*a*, and the rubber tube 56 is fitted in mounting hole 6 of the microphone 4 and is fixed with an adhesive. In this case, a ventilation hole 57 is formed in the side wall of the rubber tube 56 by laser beam machining, by which the equilibrium of air pressures between the microphone chamber 18 and the hearing aid case chamber 22 can be achieved.

Also, by using a porous polytetrafluoroethylene resin made tube etc. in place of the rubber tube 56, the equilibrium of air pressures between the microphone chamber 18 and the hearing aid case chamber 22 can be achieved without forming the ventilation hole in the side wall of tube. The ventilation hole for the equilibrium of air pressures between the microphone chamber 18 and the hearing aid case chamber 22 may be provided at any location or at a plurality of locations.

Figure 10:
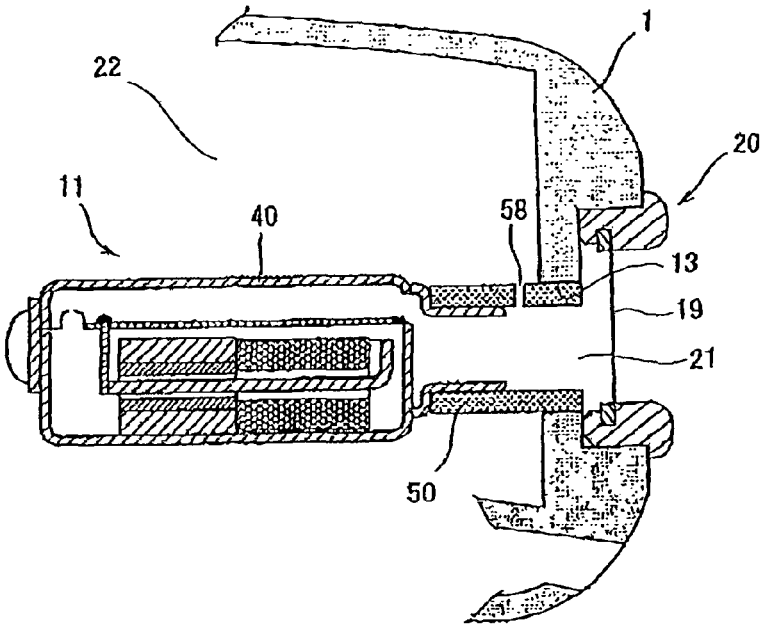
FIG. 10 is a sectional view showing another embodiment of a second ventilation means.

Next, as another embodiment of the second ventilation means, as shown in FIG. 10, a ventilation hole 58 is formed by laser beam machining in the side wall of the rubber tube 50 fitted in the mounting hole 13 and fixed with an adhesive, by which the equilibrium of air pressures between the earphone chamber 21 and the hearing aid case chamber 22 can be achieved. Also, by using a porous polytetrafluoroethylene resin made tube etc. in place of the rubber tube 50, the equilibrium of air pressures between the earphone chamber 21 and the hearing aid case chamber 22 can be achieved without forming the ventilation hole in the side wall of tube. Further, the ventilation hole for the equilibrium of air pressures between the earphone chamber 21 and the hearing aid case chamber 22 may be provided at any location or at a plurality of locations.

Figure 11:
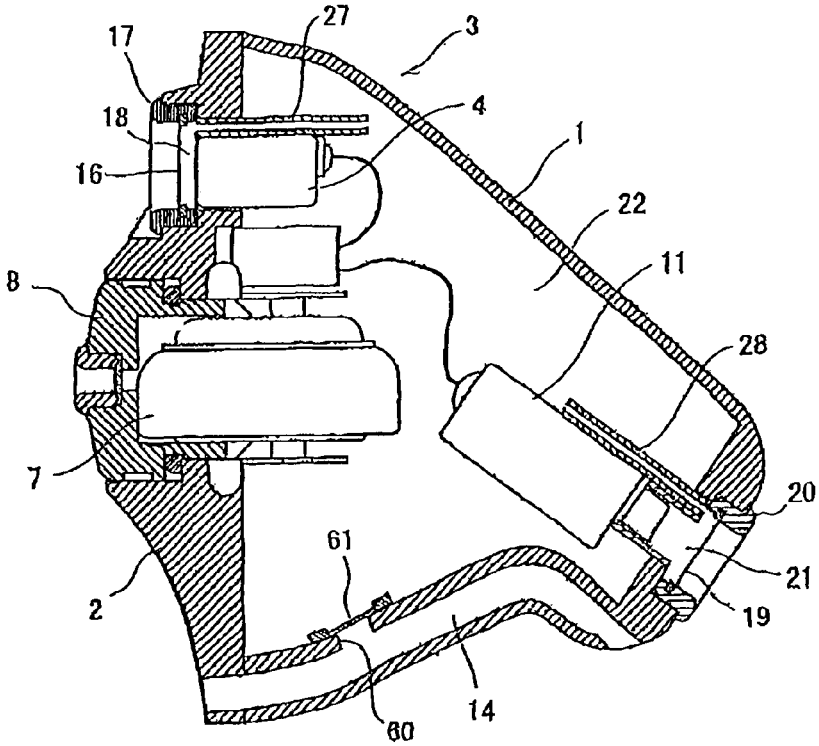
FIG. 11 is a sectional view showing another embodiment of a third ventilation means.

Next, as another embodiment of the third ventilation means, as shown in FIG. 11, an opening 60 that is open to the hearing aid case chamber 22 is provided in the vent hole 14, and this opening 60 is covered with a porous polytetrafluoroethylene film 61, by which the equilibrium of air pressures between the hearing aid case chamber 22 and the outside can be achieved through the vent hole 14. Also, by forming the vent hole 14 by a porous polytetrafluoroethylene resin made tube etc., the equilibrium of air pressures between the hearing aid case chamber 22 and the outside can be achieved without forming the ventilation hole in the side wall of tube.

If the ventilating ability between the microphone chamber 18 and the hearing aid case chamber 22 and the ventilating ability between the earphone chamber 21 and the hearing aid case chamber 22 are too high, and therefore the acoustic impedance is too low in the audio frequency band, the acoustic systems of the microphone chamber 18, the earphone chamber 21, the hearing aid case chamber 22, and the external auditory canal interfere with each other, whereby a problem concerning the hearing aid characteristics may be posed.

Therefore, these ventilating abilities are determined so that the equilibrium of air pressures is achieved in a period of time as short as several seconds or shorter, and the acoustic impedance is high to a degree such that a change in characteristics is negligible as compared with the case where no ventilation means is provided. For the tube (first ventilation means) 27 and the tube (second ventilation means) 28 shown in FIG. 5, an inside diameter of 0.1 mm and a length of 10 mm were used.

Industrial Applicability

According to the present invention, there is provided a waterproof hearing aid capable of being worn without caring about the entry of sweat or water even at the time of sweating or bathing. Therefore, the waterproof hearing aid becomes easy to handle, so that a demand for the waterproof hearing aid can be increased.

Although there have been described what are the present embodiments of the invention, it will be understood that variations and modifications may be made thereto within the scope of the claims appended hereto.

The invention claimed is:

1. A waterproof hearing aid having a first waterproof film stretchingly provided at a sound inlet of a microphone and a second waterproof film stretchingly provided at a sound outlet of an earphone, comprising:

a first vent communicating a microphone chamber formed by the first waterproof film and the microphone with an open space within a hearing aid case chamber formed by a hearing aid case during use of the hearing aid;

a second vent communicating an earphone chamber formed by the second waterproof film and the earphone with the open space within the hearing aid case chamber during use of the hearing aid; and a third vent communicating the open space within the hearing aid case chamber with an external ambient environment during use of the hearing aid.

2. The waterproof hearing aid according to claim 1, wherein the first vent is one of a tube projecting into the hearing aid case chamber, a ventilation hole provided in a side wall of a tube forming a part of the microphone chamber, a permeable porous tube forming a part of the microphone chamber, and a ventilation hole provided in a microphone case.

3. The waterproof hearing aid according to claim 1, wherein the second vent is one of a tube projecting into the hearing aid case chamber, a ventilation hole provided in a side wall of a tube forming a part of the earphone chamber, and a permeable porous tube forming a part of the earphone chamber.

4. The waterproof hearing aid according to claim 1, wherein the third vent uses a porous film that allows a gas to pass therethrough, and resists passage of a liquid therethrough.

5. The waterproof hearing aid according to claim 1, wherein the first waterproof film and the second waterproof film are replaceable.

6. A waterproof hearing aid having a first elastic high-molecular film stretchingly provided at a sound inlet of a microphone and a waterproof film stretchingly provided at a sound outlet of an earphone, comprising:

a hearing aid case chamber formed by a hearing aid case; and a first vent communicating a microphone chamber, formed by the first elastic high-molecular film and a microphone, with an open space within the hearing aid case chamber during use of the hearing aid; and a second vent communicating an earphone chamber, formed by the waterproof film and an earphone, with the open space within the hearing aid case chamber.

7. The hearing aid according to claim 6, wherein the first vent is provided at any location in the microphone chamber.

8. The hearing aid according to claim 6, wherein the first vent is provided in a microphone case.

9. The hearing aid according to claim 6, wherein the second vent is provided at any location in the earphone chamber.

10. A waterproof hearing aid having a first elastic high-molecular film provided at a sound inlet of a microphone and a second elastic high-molecular film provided at a sound outlet of an earphone, comprising:

a hearing aid case chamber formed by a hearing aid case; and a first vent communicating a microphone chamber, formed by the first elastic high-molecular film and a microphone, with an open space within the hearing aid case chamber during use of the hearing aid; and a second vent communicating an earphone chamber, formed by the second elastic high-molecular film and an earphone, with an open space within the hearing aid case chamber during use of the hearing aid.

11. The hearing aid according to claim 10, wherein the second vent is provided at any location in the earphone chamber.

12. The waterproof hearing aid according to claim 1, wherein said third vent blocks passage of water and sweat.

13. The waterproof hearing aid according to claim 1, wherein the first and second waterproof films are formed of an elastic high molecular film, and the third vent is formed of a porous film that blocks passage of water and sweat.

14. The waterproof hearing aid according to claim 1, wherein the first and second waterproof films are formed as parts of replaceable chips.

15. The waterproof hearing aid according to claim 1, wherein the first and second vents include tubes formed of porous PTFE resin.

16. The waterproof hearing aid according to claim 1, wherein the third vent is formed in a battery cover of the hearing aid as a through hole which allows the external ambient environment and an interior of the hearing aid case to communicate.

* * * * *